US007087850B1

(12) United States Patent
Murzanski

(10) Patent No.: US 7,087,850 B1
(45) Date of Patent: Aug. 8, 2006

(54) CLEANABLE KEYBOARD

(75) Inventor: Chris A. Murzanski, Issaquah, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 11/237,241

(22) Filed: Sep. 27, 2005

(51) Int. Cl.
*H01H 9/04* (2006.01)

(52) U.S. Cl. ..... 200/302.1; 200/302.2; 200/341; 400/472; 400/490

(58) Field of Classification Search ..... 200/302.1, 200/302.2, 5 A, 5 R, 341; 400/472, 490, 400/495, 496
See application file for complete search history.

(56) References Cited

U.S. PATENT DOCUMENTS 4,555,600 A * 11/1985 Morse ..... 200/5 A
5,117,074 A * 5/1992 Yanai et al. ..... 200/302.3
5,824,981 A * 10/1998 Suzuki ..... 200/302.1
6,156,983 A * 12/2000 Chen et al. ..... 200/302.1
6,610,944 B1 * 8/2003 Lee et al. ..... 200/302.1
6,705,787 B1 * 3/2004 Jeffries et al. ..... 400/714

* cited by examiner

*Primary Examiner*—K. Lee
(74) *Attorney, Agent, or Firm*—Banner & Witcoff, Ltd.

(57) ABSTRACT

In an embodiment, a keyboard includes a barrier layer. The barrier layer may be mounted between an upper and lower housing portion of the keyboard so as to provide a substantially water impermeable pocket about a keyboard circuit. The barrier layer includes at least one key aperture that allows the barrier layer to attach to a key, the attachment providing a substantially water impermeable seal between the barrier layer and the key. Thus, the barrier layer acts to prevent liquids that are spilled on the keys from contacting and damage an electrical keyboard circuit provided below the barrier layer. In an embodiment the keyboard may be rinsed under running water without damaging the keyboard circuit.

20 Claims, 11 Drawing Sheets

CLEANABLE KEYBOARD

BACKGROUND

A keyboard is a standard part of a desktop computer. It allows a user to enter data, compose written verbiage and do other useful tasks. The keyboard includes one or more keys with symbols such as the letters A–Z and numbers and punctuation marks. A keyboard may also typically includes additional keys of various sizes such as a space bar, an enter key and the like.

Keyboards typically come in two basic configurations: wired and wireless. While wired keyboards are generally less expensive, wireless keyboards are becoming more popular because they eliminate the need for cords that otherwise clutter up the workspace. Thus, both types of keyboards are found in a variety of settings, depending on what is needed.

One consequence of the proliferation of computers and associated keyboards is that keyboards are now being used in a variety of settings outside of office spaces and other standard work places. This has increased the keyboard's exposure to various environmental factors. For example, users drink various liquids while working with computers and keyboards. On occasion a user will inadvertently spill the liquid and the increase usage along with the variations in locations increases the odds that liquid will be spilt on the keyboard.

As can be appreciated, spilling plain water on a keyboard can be a problem because the water may cause the electrical keyboard circuit to short out and/or corrode. This problem is further exasperated when liquids such as coffee, soft drinks or juices are spilled on the keyboard. Even if the liquid does not short out the circuitry of keyboard or cause corrosion, once the liquid evaporates the keyboard keys are likely to stick because of the residue left behind. Therefore, once a liquid is spilled on the keyboard its useful life is typically substantially reduced.

Another issue with keyboards is that they tend to be unsanitary. Studies have shown that keyboards have high levels of bacteria on the keys. While this has potential health ramifications for a solitary user, the potential spread of bacteria and viruses is a serious issue in facilities such as hospitals where multiple users may use a single keyboard over a period of time. Unfortunately, standard keyboards are poorly suited to cleaning. While it is possible to use a plastic cover over the keyboard, this has a negative impact on the user's ability to use to keyboard and therefore is undesirable.

SUMMARY

A keyboard is provided with a barrier layer that protects the internal components of the keyboard. The barrier layer, which may be silicone, extends between input keys and a sealing surface that forms a perimeter so as to provide a substantially water impermeable pocket surrounding internal components of the keyboard. Thus, internal components of the keyboard are kept safe from liquids in the case of a spill. Depending on the configuration and design of the barrier layer, the keyboard may allow for rinsing under running water.

BRIEF DESCRIPTION OF THE DRAWINGS

The present invention is illustrated by way of example and not limited in the accompanying figures in which like reference numerals indicate similar elements and in which.

DETAILED DESCRIPTION

Keyboards have been used for some time in connection with computers. While other methods of input have been used with some success, the keyboard remains one of the preferred methods of interfacing with a computer. As can be appreciated, numerous variations regarding the aesthetic appearance of the keyboard is possible. In addition, numerous variations in the number, arrangement and size of various keys are also possible. Unless otherwise noted, this disclosure is not intended to be limiting in this respect.

Figure 1:
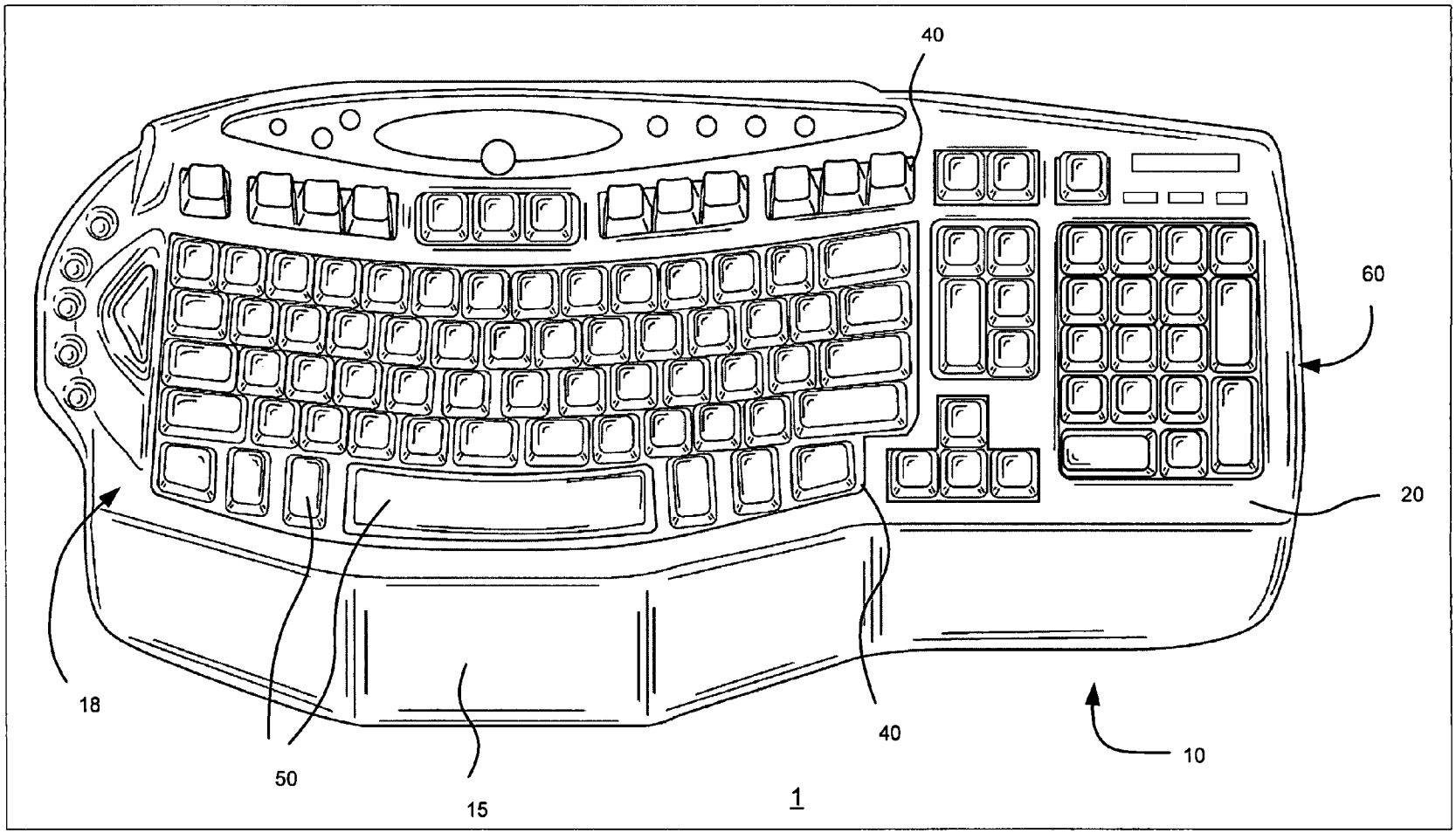
FIG. 1 illustrates a plan view of an exemplary embodiment of a keyboard in accordance with an aspect of the present invention.

Turning to FIG. 1, an exemplary embodiment of a keyboard 10 on a support surface 1 is depicted. The keyboard 10 includes a housing 18 that includes an upper housing potion 20. Provided in the upper housing portion 20 are a plurality of key openings 40. As can be appreciated, the shape and number of the openings 40 that are provided is primarily limited by the outer edge 60 of the keyboard 10.

Positioned within the openings 40 are a plurality of input keys 50. As can be appreciated, different input keys 50 may have different shapes. It should be noted that groups of input keys 50 may be arranged as desired to provide the desired user experience. In an embodiment, the input keys 50 may be arranged so as to provide a QWERTY keyboard. Additional input keys 50 may be added as desired, the only limitation being the overall size of the keyboard 10 and the individual size of the input keys 50.

As is known, certain input keys 50 are used more frequently than other input keys 50. For example, the space bar is used relatively frequently. Therefore, keyboard designers may use the frequency of usage as one variable in deciding how large a particular input key 50 should be, keeping in mind the user's expectations. Regardless of the reasons, some of which are historical, often the various input keys 50 are not uniform in size. It is desirable, but not necessary, that the effort required to press the various input keys 50 be kept fairly uniform, regardless of the size of individual input keys 50, so as to provide the user with a consistent feedback force whenever the input key 50 is used. This may involve adjusting various factors that will be discussed below through an iterative process so as to provide the desired feedback force.

As noted above, the keyboard 10 may be provided in a variety of shapes and sizes. Other components may be added to the keyboard 10. For example, as depicted, the keyboard 10 includes a cushion 15 that provides an improved ergonomic aspect to the keyboard 10. Other components may also be connected to or imbedded into the housing 18 without departing from the scope of this invention.

Figure 2:
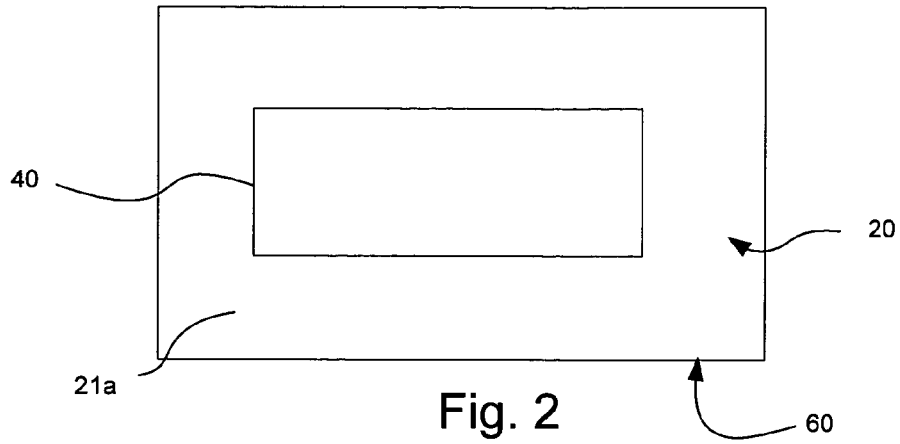
FIG. 2 illustrates a plan view of a simplified upper housing in accordance with an aspect of the present invention.
Figure 3:
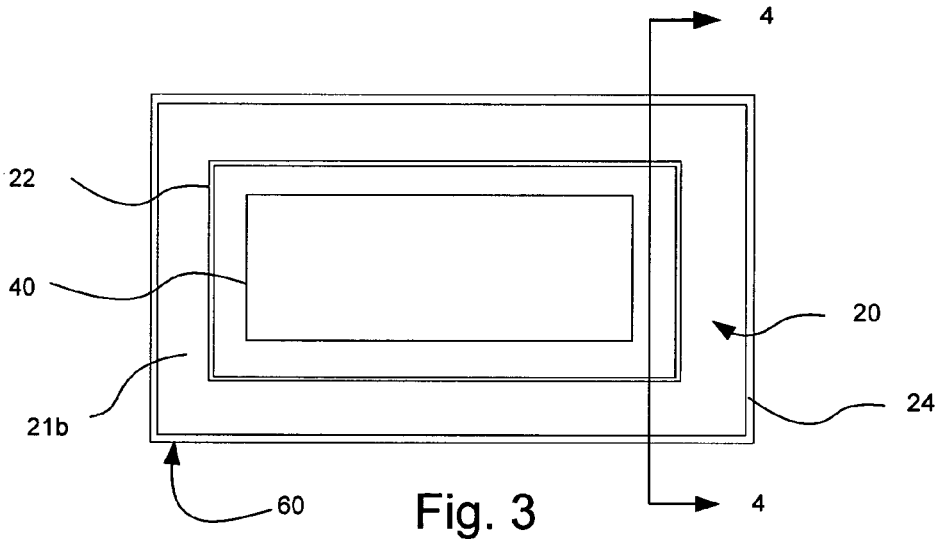
FIG. 3 illustrates a bottom view of the upper housing depicted in FIG. 2 in accordance with an aspect of the present invention.
Figure 4:
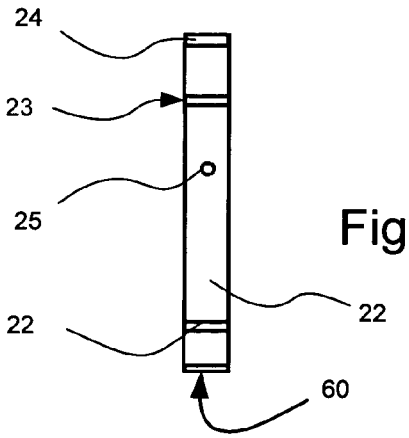
FIG. 4 illustrates a cross-sectional view taken along the line 4—4 in FIG. 3 in accordance with an aspect of the present invention.

Turning to FIGS. 2, 3 and 4, a simplified embodiment of the upper housing portion 20 is depicted, the upper housing portion 20 including a first surface 21*a*, a second surface 21*b*, the opening 40 and the outer edge 60. The upper housing portion 20 further includes a first sealing rib 22 and an outer rib 24. As can be appreciated, the first sealing rib forms an inner perimeter that surrounds the opening 40 and the outer rib 24 forms an outer perimeter around the inner perimeter. As depicted, a first sealing surface 23 is provided on the first sealing rib 22, the first sealing surface 23 configured to form a perimeter seal around the opening 40. In addition, a drain hole 25 is depicted as being provided on the first sealing rib 22. In an embodiment the shape and location of the drain hole may be modified. In an embodiment the drain hole 25 may be positioned closer to the first sealing surface 23 of the first sealing rib 22. In an embodiment the first sealing rib 22 may be omitted and the first sealing surface 23 may be provided on the second surface 21*b* of the upper housing portion 20.

Figure 5:
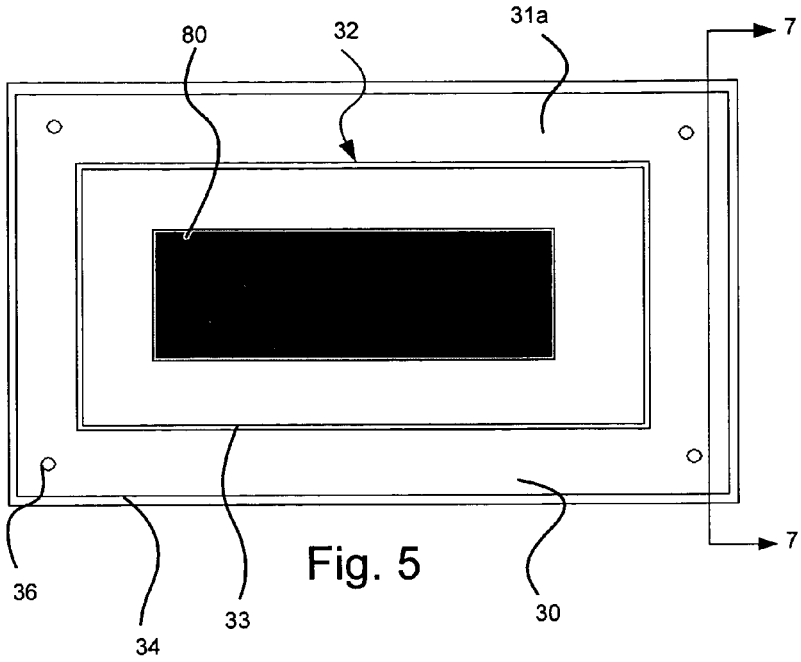
FIG. 5 illustrates a plan view of an exemplary lower housing portion in accordance with an aspect of the present invention.
Figure 6:
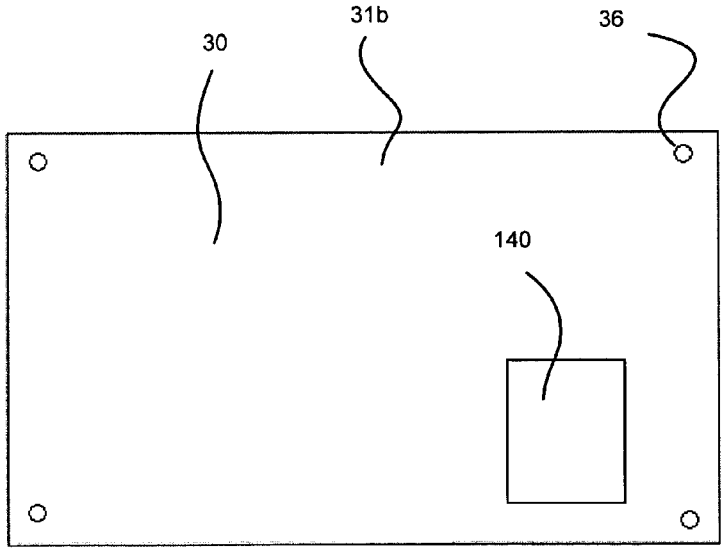
FIG. 6 illustrates a bottom view of the embodiment of the lower housing portion depicted in FIG. 5 in accordance with an aspect of the present invention.
Figure 7:
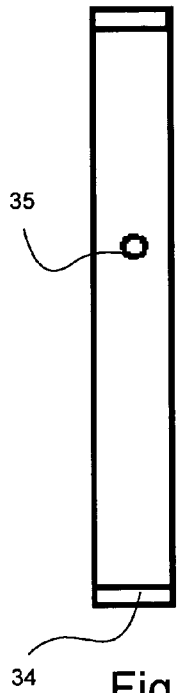
FIG. 7 illustrates a cross-sectional view taken along the line 7—7 in FIG. 5 in accordance with an aspect of the present invention.
Figure 11:
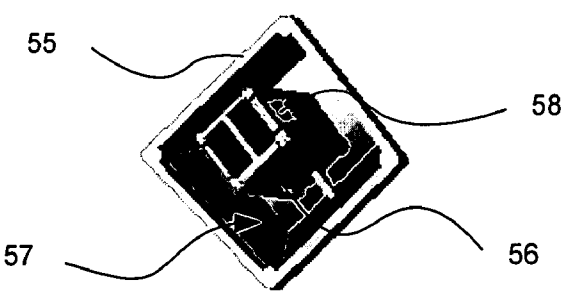
FIG. 11 illustrates an elevated bottom view of the key depicted in FIG. 8 in accordance with an aspect of the present invention.
Figure 9:
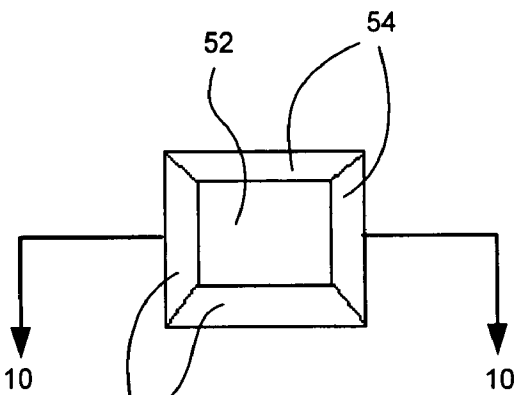
FIG. 9 illustrates a plan view of the key depicted in FIG. 8 in accordance with an aspect of the present invention.
Figure 10:
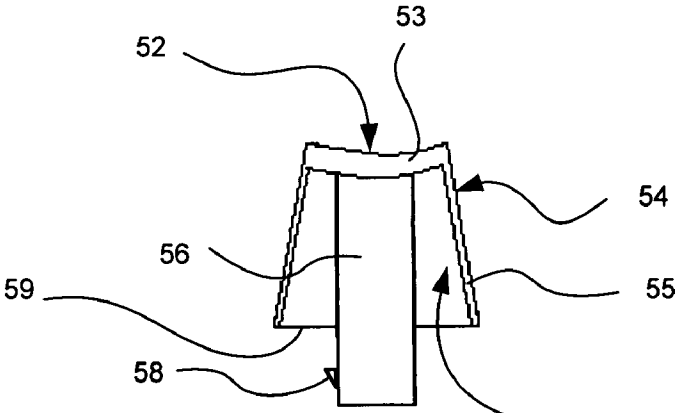
FIG. 10 illustrates a cross-sectional view taken along the line 10—10 in FIG. 9 in accordance with an aspect of the present invention.
Figure 8:
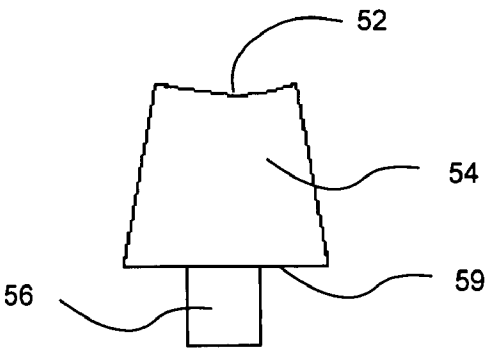
FIG. 8 illustrates a front view of an exemplary key in accordance with an aspect of the present invention.

Turning to FIGS. 5, 6 and 7, an embodiment of a lower housing portion 30 is depicted, the lower housing portion 30 being configured to be fastened to the upper housing portion 20 so as to form part of the housing 18. As depicted, the lower housing portion 30 includes a second sealing rib 32 with a second sealing surface 33 and a plurality of fastener apertures 36 positioned between the second sealing surface 33 and an outer edge 34. As depicted, the second sealing surface 33 is configured, so that when the keyboard 10 is assembled, the second sealing surface 33 is aligned with the first sealing surface 23 of the upper housing portion 20. Thus, the first and second sealing surfaces 23, 33, in combination with the barrier layer, discussed below, form a perimeter seal that extends around the opening 40.

It should be noted that the keyboard 10 may be wireless. In an embodiment, as depicted in FIG. 6, the lower housing portion 30 may includes a releasable panel 140. In an embodiment the releasable panel 140 may cover a power source. In an embodiment the releasable panel 140 seals to the lower housing portion 30 when in the installed position so as to aid in protecting the internal components of the keyboard 10 from exposure to liquids.

As depicted, the lower housing portion 30 further includes a third surface 31*a* and a fourth surface 31*b*. In an embodiment, the second sealing rib 32 may be omitted and the second sealing surface 33 may be provided on the third surface 31*a*. It should be noted, however, that it may be advantageous to provide at least one sealing rib on either the upper housing portion 20 or the lower housing portion 30 so as to aid in the sealing of the upper housing portion 20 to the lower housing portion 30 (discussed in great detail below).

As noted, one or more fastener holes 36 may be provided and these fastener holes 36, if used, may align with associated fastener receiving components (not shown) on the upper housing portion 20. If provided, it may be beneficial to locate the fasteners holes 36 between the second sealing surface 33 and the outer edge 34 for reasons that will be discussed below.

As depicted, the lower housing portion 30 supports a keyboard circuit 80. As is known, the keyboard circuits 80 convert displacement of (or forces exerted on) the input key 50 into signals that represent a particular input key 50 being pressed. Numerous methods exist for doing this, including but not limited to, opening or closing an electrical circuit or sensing a change in magnetic fields. As numerous methods are known to persons of skill in the art, no further discussion will be provided and this disclosure is not intended to be limiting in this respect.

FIGS. 8, 9, 10 and 11 illustrate an exemplary embodiment of the input key 50. While numerous materials are possible, in an embodiment the input key 50 may be made of a molded plastic and may include fillers as appropriate. As depicted, the input key 50 includes a key top surface 52, a plurality of side walls 54 and a support leg 56. It should be noted that depending on the design of the input key 50, one or more side walls 54 may be provided. Looking at FIG. 10, the side wall 54 has a thickness 55 and includes an inner surface 57. The thickness 55 may vary as needed but preferably the thickness 55 will be similar to a thickness 53 of the key top surface 52 so as to allow for ease of manufacture.

As depicted, the support leg 56 includes a retainer 58. While not required, the retainer 58 beneficially prevents the input key 50 from being removed from the keyboard 10 once the input key 50 is installed.

As depicted, the side walls 54 end at a key edge 59. Thus, the side walls 54 act as a protective cover for a portion of the support leg 56. The benefit of this optional protective covering will be discussed below.

Figure 12:
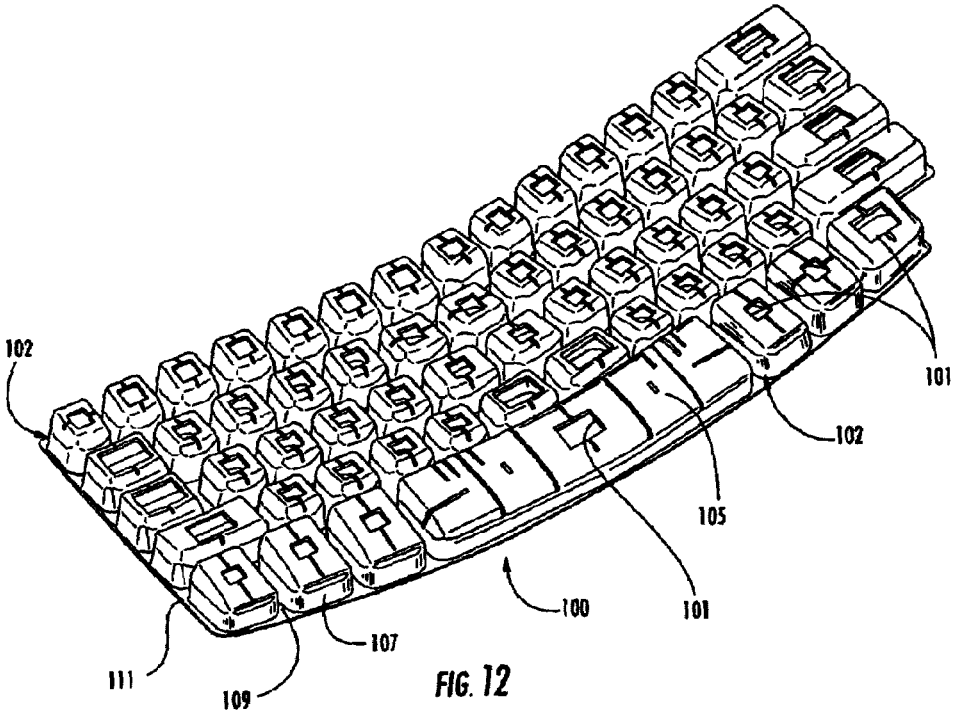
FIG. 12 illustrates an elevated view of an exemplary barrier layer in accordance with an aspect of the present invention.

Turning to FIG. 12, a barrier layer 100 is depicted. While numerous materials and configurations may be used, in an embodiment the barrier layer may be made of silicone and may be between 0.5 and 1.0 mm thick. Typically silicone is difficult to mold when the wall thickness drops below 0.5 mm. However, in an alternative embodiment, the barrier layer 100 may be made of silicone material having an elastic modulus of less than 5 MPa and using such a material may make it possible to produce a barrier layer 100 with a thickness less than 0.5 mm. As can be appreciated, using such a thin barrier layer 100, by reducing the amount of material used, tends to reduce the cost and weight of the keyboard and thus makes it more desirable to the user. Relatively speaking, a thinner barrier layer 100 is more flexible than a thicker barrier layer 100 and this flexibility may be helpful in minimizing the impact of the barrier layer 100 on the feedback force experienced by the user. This can have the advantage of making the process of designing the keyboard 10 simpler and less time consuming.

As depicted, the barrier layer 100 includes a plurality of upwardly extending projections 102 with a plurality of key apertures 101 on a top surface 105 of the plurality of upwardly extending projections 102. The barrier layer 100 also includes a base 109 that includes an outer edge 111. As depicted, the plurality of projections 102 includes a barrier wall 107, more of which will be discussed below. As depicted the outer edge 111 is approximate the barrier walls 107 and does not extend outward to any significant degree. In an embodiment, the outer edge 111 may extend outward some additional distance so as to improve the assembly process of keyboard 10.

Figure 13:
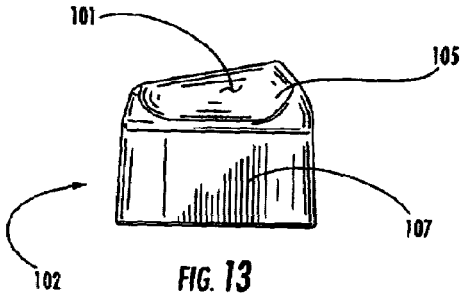
FIG. 13 illustrates a side view of an upwardly extending projection in accordance with an aspect of the present invention.
Figure 14:
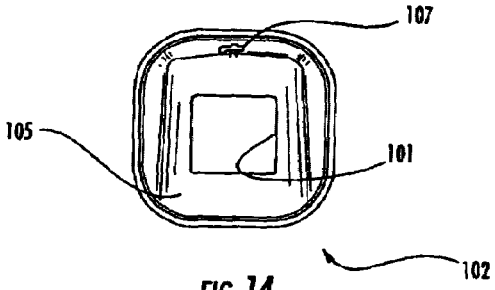
FIG. 14 illustrates a plan view of the upwardly extending projection depicted in FIG. 13 in accordance with an aspect of the present invention.
Figure 15:
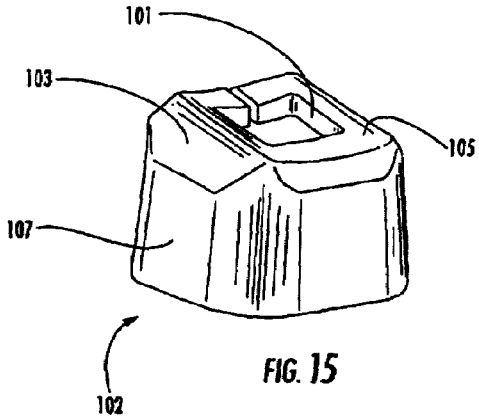
FIG. 15 illustrates an elevated view of the dome portion depicted in FIG. 13 in accordance with an aspect of the present invention.

Turning to FIGS. 13, 14 and 15, an exemplary embodiment of the upwardly extending projection 102 of the barrier layer 100 is depicted. As depicted, the barrier layer includes the barrier wall 107, the top surface 105 and the key aperture 101. As further illustrated, the upwardly extending projection 102 also includes an angled wall 103.

As depicted, the key aperture 101 has a rectangular shape. While other shapes are possible depending on the design of the barrier layer and the interfacing input key 50 (FIGS. 8–11), in an embodiment the key aperture 101 may correspond to the shape of the support leg 56. In an embodiment, the size of the key aperture 101 may be less than the size of the support leg 56 so that there is an interference fit between the input key 50 and the barrier layer 100. While somewhat dependent on the shape of the support leg 56 and the shape of the key aperture 101, in an embodiment the interference fit may range between 0.2 and 0.5 mm. In other words, a perimeter of the portion of the input key 50 that seals against the barrier layer 100 may have dimensions larger than the key aperture 101 in the barrier layer 100.

Figure 16:
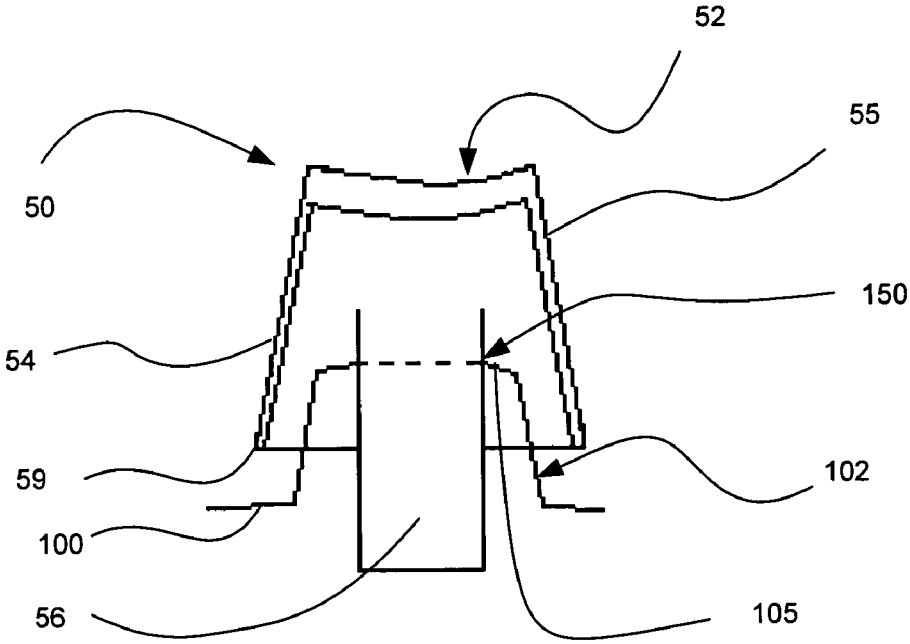
FIG. 16 illustrates a cross-sectional view of an exemplary embodiment of a key fitted to a barrier layer in accordance with an aspect of the present invention.

Before discussing additional details regarding the upwardly extending projection 102, FIG. 16 illustrates an embodiment of the input key 50 assembled to the barrier layer 100. Looking at FIG. 16, a cross-section of the barrier layer 100 fitted to the input key 50 is illustrated, the cross-section taken along lines similar to the line 10—10 in FIG. 9. As depicted, the support leg 56 is inserted into the key aperture 101 (FIG. 14). As can be appreciated, the support leg 56 and the barrier layer 100 interface at a junction 150 that is positioned above the key edge 59 but below the key top surface 52. Thus, liquid being spilled from above the key 100 can cascade over the input key 50 and collect on the base 109 (FIG. 12). Thus, gravity will help prevent the liquid poured on the keyboard 10 from traveling upward along the barrier wall 107 of the upwardly extending projection 102. In an embodiment, the drain holes 25, 35 (FIGS. 4 and 7) may be configured to allow the liquid to automatically drain away from the keyboard 10 when the keyboard 10 is positioned on the support surface 1 in an intended working position. In an alternative embodiment, the keyboard 10 may be configured to contain the liquid so that it may be safely disposed of by the user. As can be appreciated, while allowing the liquid to drain away under the influence of gravity minimizes the length of time the liquid is in contact with the barrier layer 100, it may be useful to contain the liquid so as to avoid further spreading of the liquid across the user's work surface.

As can be appreciated, locating the key aperture 101 on the top surface 105 helps prevent the liquid from contacting the interface between the barrier layer 100 and the support leg 56. However, in the event that liquid does come into contact with the interface between the barrier layer and the support leg 56, the interference fit between the barrier layer 100 and the support leg 56 may act to prevent water from passing through the junction 150. Thus, in an embodiment the keyboard 10 may be rinsed under running water. Furthermore, if the barrier layer comprises silicone and the input keys 50 comprise a suitable material such as plastic, then the keyboard 10 may be cleaned with ordinary household cleaners without concern that the keyboard will be damaged, thus enabling ready sanitation of the keyboard 10. It should be noted that it may be useful to position any symbols on the input keys 50 in a manner that does not allow ordinary household cleaners to cause the symbols to fade or be obscured.

Turning back to FIGS. 13 and 15, as depicted the top surface 105 is not flat. Furthermore, the upwardly extending projection 102 includes the angled wall 103. As previously mentioned, it is desirable to provide uniform force feedback to the user so that regardless of which key is pressed, the same approximate feedback force is provided to the user. To aid in providing feedback, the angle of the barrier wall 107 and the angled wall 103 may be modified. For example, the barrier wall 107 may be at, without limitation, an 83.5 or an 87.5 degree angle from horizontal. As can be appreciated, this flexibility allows for greater customizability of the feedback force. As the actual feedback force necessarily various depending on the design of the key, the design of the support leg, the method of mounting the key to the lower housing portion 30, and the thickness of the barrier layer 100, the actual shape of the top surface 105, the angled wall 103 and the barrier wall 107, if optimization is desired, may be determined through an iterative process. For example, finite element analysis may be used to determine whether a change in angle affects the force feedback provided to the user. In an embodiment, depending on the thickness of the barrier layer 100, a small change of less than five degrees in the angle of the barrier wall 107 may have a minor impact on the level of feedback force noticed by the user.

As noted above, the barrier layer 100 may be provided in various thicknesses. As can be appreciated, varying the thickness will also affect the feedback force felt by the user. Thus, for a given geometry, increasing the thickness of the barrier layer 100 will generally increase the feedback force. In addition, increasing, from horizontal, the angle of the barrier wall 107 and the angled wall 103 will generally increase the feedback force.

Referring to FIG. 16, it should be noted that if there is an interference fit between the input key 50 and the barrier layer 100 such that the two are sealably joined, the barrier layer 100 will need to deflect if the input key 50 is to move. Therefore, if the interface between the barrier layer 100 and the support leg 56 is positioned between the key edge 59 and the key top surface 52 (as depicted in FIG. 16), care should be take to ensure there is sufficient space around the upwardly extending projection 102 (e.g. between the inner surface 57 and the barrier wall 107) so as to allow the upwardly extending projection 102 to fold or otherwise deform or deflect in response to the downward movement of the input key 50.

Figure 18:
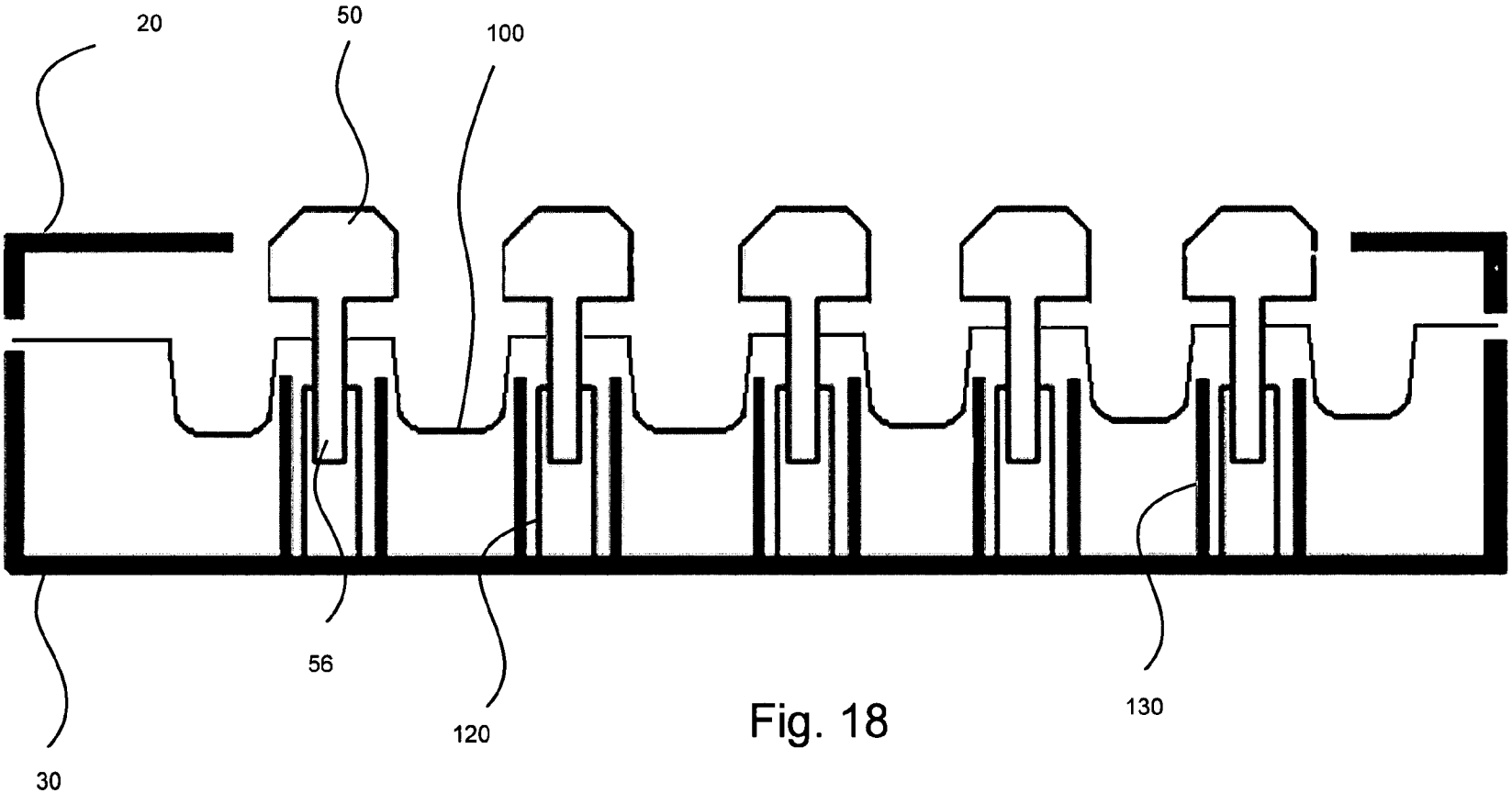
FIG. 18 illustrates a simplified cross-sectional view of an exemplary embodiment of a keyboard in accordance with an aspect of the present invention.

Turning to FIG. 18, a simplified cross-section of an exemplary keyboard 10 is illustrated. The barrier layer 100 is depicted interfacing with the support legs 56 below the key edge 59 (FIG. 8) for ease of illustration. However, as noted above in FIG. 16, the barrier layer 100 may interface with the support leg 56 between the key edge 59 and the key top surface 52 so as to provide additional protection for the junction 150 between the support leg 56 and the barrier layer 100.

While depicted as not in contact for ease of illustration and improved comprehension, in practice the upper housing portion 20, the lower housing portion 30 and the barrier layer 1000 will be compressed together so as to prevent liquids poured on the input keys 50 from above from passing beyond the barrier layer. Thus, in an embodiment the first sealing surface 23 (FIG. 2), the second sealing surface 33 (FIG. 5) and the barrier layer 100 may form a substantially liquid impermeable perimeter around the input keys 50 provided in the opening 40.

The barrier layer 100 also attaches to the input keys 50. In other words, the barrier layer 100 sealably attaches to the plurality of input keys 50 and sealably mounts to the upper and lower housing portions 20, 30 so as to provide a keyboard 10 that, in an embodiment, may be rinsed under running water. It should be noted that sealing the upper and lower housing portion 20, 30 together with the barrier layer 100 has the effect of providing a sealed perimeter around the opening 40 in the upper housing portion 20. This, in turn creates a substantially liquid impermeable pocket formed by the barrier layer 100, the input keys 50 and the lower housing portion 30. Thus, typical electronic components and other common mechanical keyboard components may be position within the pocket with little concern about liquid harming the protected components.

Referring back to FIG. 5, locating the fastener opening 36 outside of the sealing surfaces 25, 35 (e.g. the sealed perimeter) helps minimize leak paths into the substantially liquid impermeable pocket formed by the second sealing surface 33, the barrier layer 100, the lower housing portion 30 and the input keys 50. Thus, liquid is unlike to reach the keyboard circuit 80 (FIG. 5). Other configurations with one or more fasteners positioned inside the substantially liquid impermeable pocket, while less desirable, are also possible. Thus, in an alternative embodiment, the fasteners opening 36 may be positioned in the middle of the sealing surfaces 25, 35. In such an embodiment care should be taken to minimize leakage through the fastener opening 36.

As depicted, the support leg 56 is supported by a compliant element 120 and a well 130. As can be appreciated, however, in an alternative embodiment the support leg 56 may be configured to fit over a support bar (not shown). Thus, variations in how the support leg 56 interfaces with and is support by the lower housing portion 30 are envisioned as being within the scope of the present invention.

The compliance element 120 may be a variety of designs such as various known spring designs and/or compressible materials. In an embodiment, the compliance element 120 and the barrier layer 100 work to provide a relatively uniform force feedback. As can be appreciated, the feedback force for a given input key 50 may be adjusted by varying properties and/or the shape of either the barrier layer 100 or the compliance element 120 as appropriate. In an embodiment, different input keys 50 may have different configurations of the upwardly extending projection 102 so as to provide a relatively uniform feedback force in response to a user depressing the different input keys 50.

Figure 17:
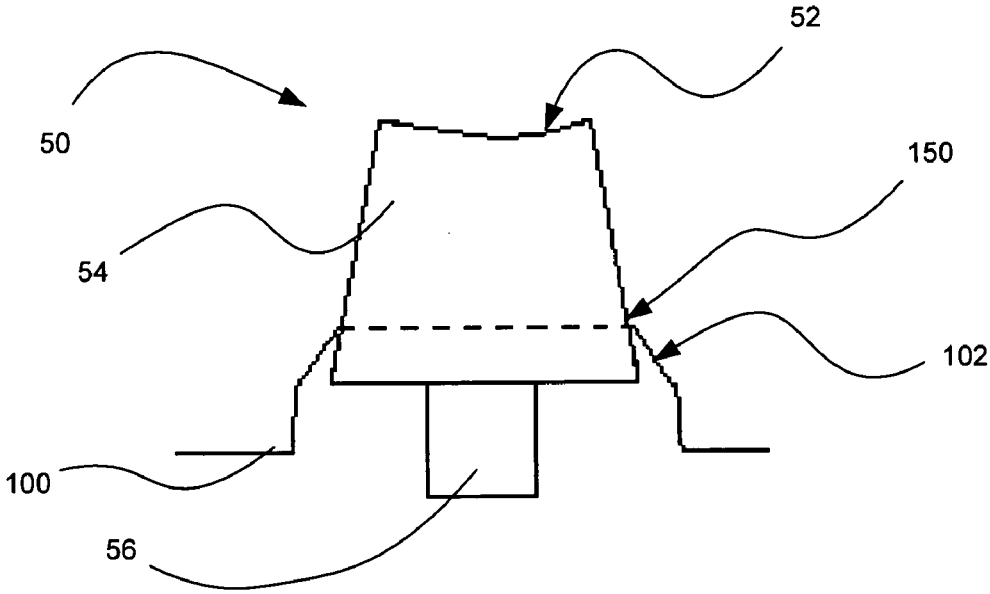
FIG. 17 illustrates a cross-sectional view of an alternative exemplary embodiment of a key fitted to a barrier layer in accordance with an aspect of the present invention.
Figure 19:
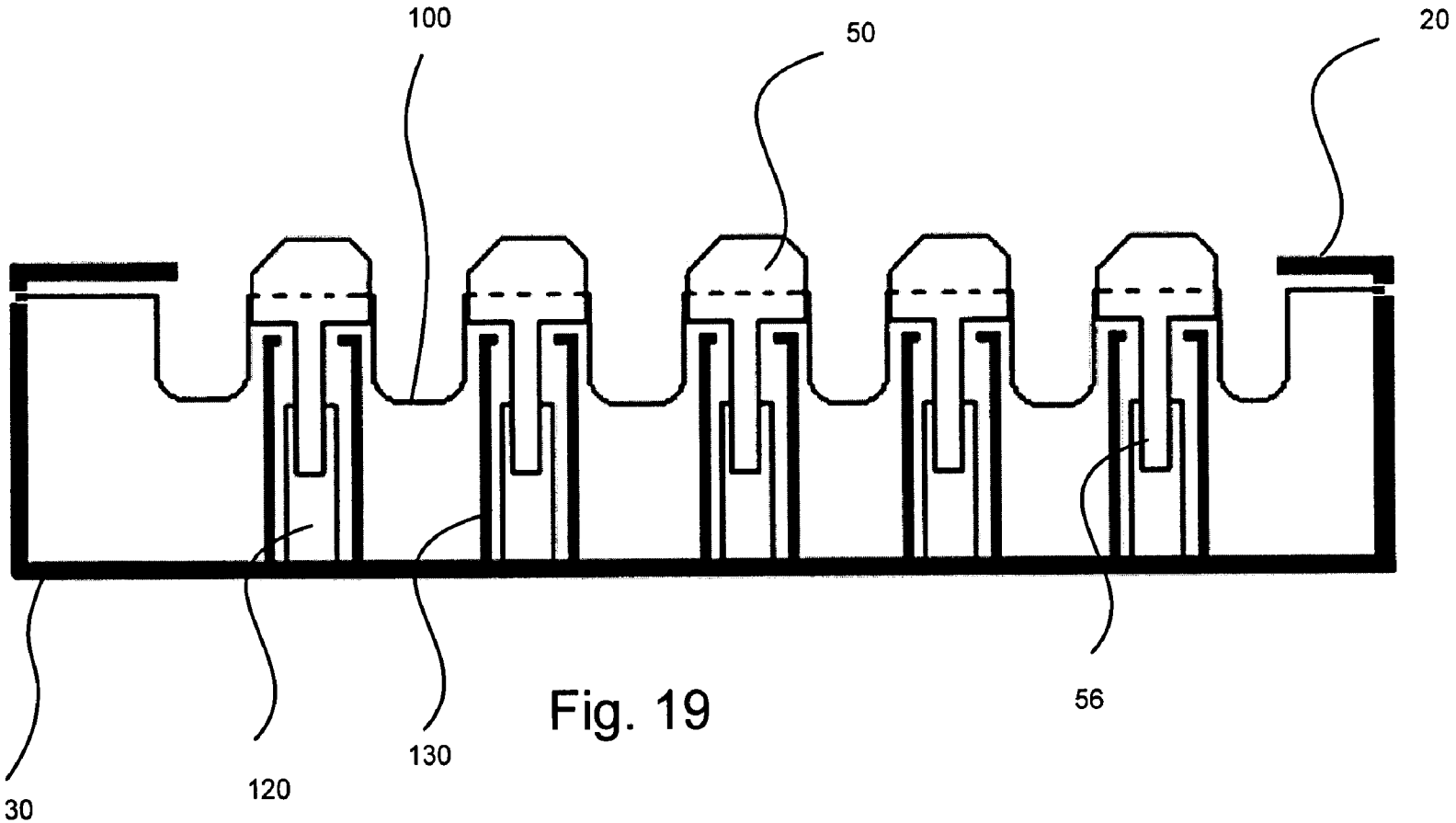
FIG. 19 illustrates a simplified cross-sectional view of an alternative exemplary embodiment of a keyboard in accordance with an aspect of the present invention.

FIGS. 17 and 19 illustrate an alternative embodiment with the barrier layer 100 interfacing with the side walls 54 of the input key 50. While similar to the embodiment depicted in FIGS. 16 and 18, as can be appreciated, such a design directly exposes a junction 150 between the key aperture 101 and the input key 50 to spilled liquids. Therefore, in an embodiment, the fit between the barrier layer 100 and the input key 50 may be relatively tight so as to provide a substantially liquid impermeable junction.

Figure 20:
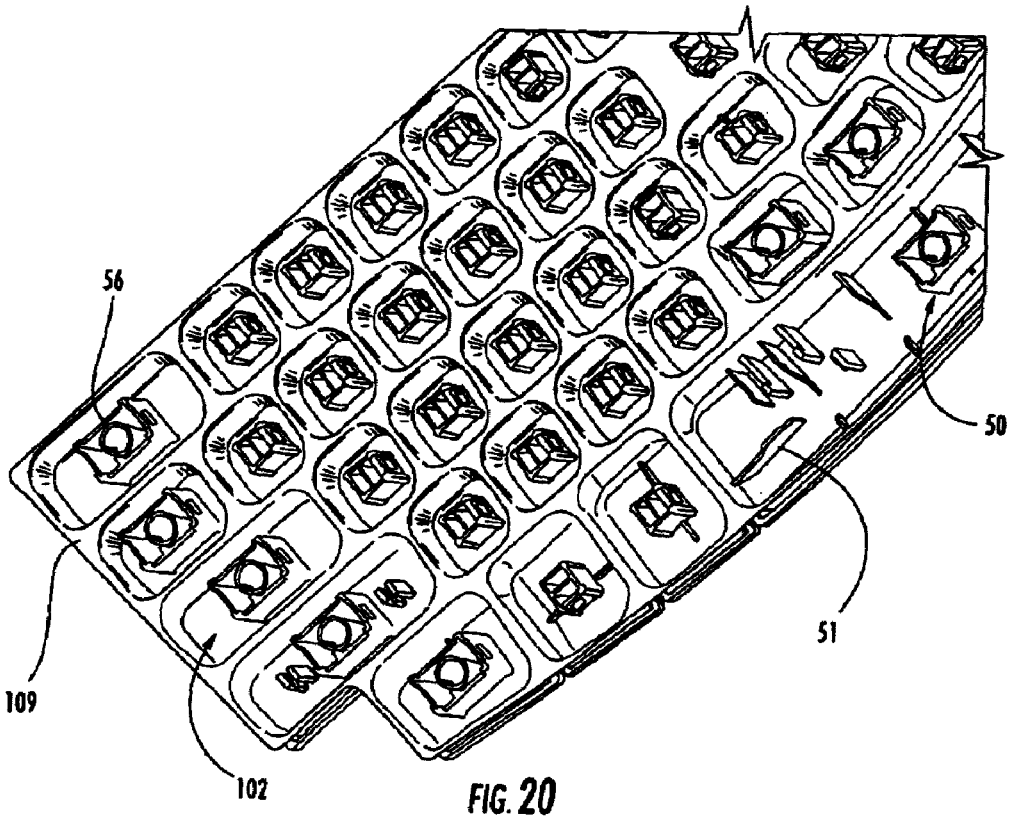
FIG. 20 illustrates elevated bottom view of an exemplary embodiment of a plurality of keys fitted in a barrier layer in accordance with an aspect of the present invention.
Figure 21:
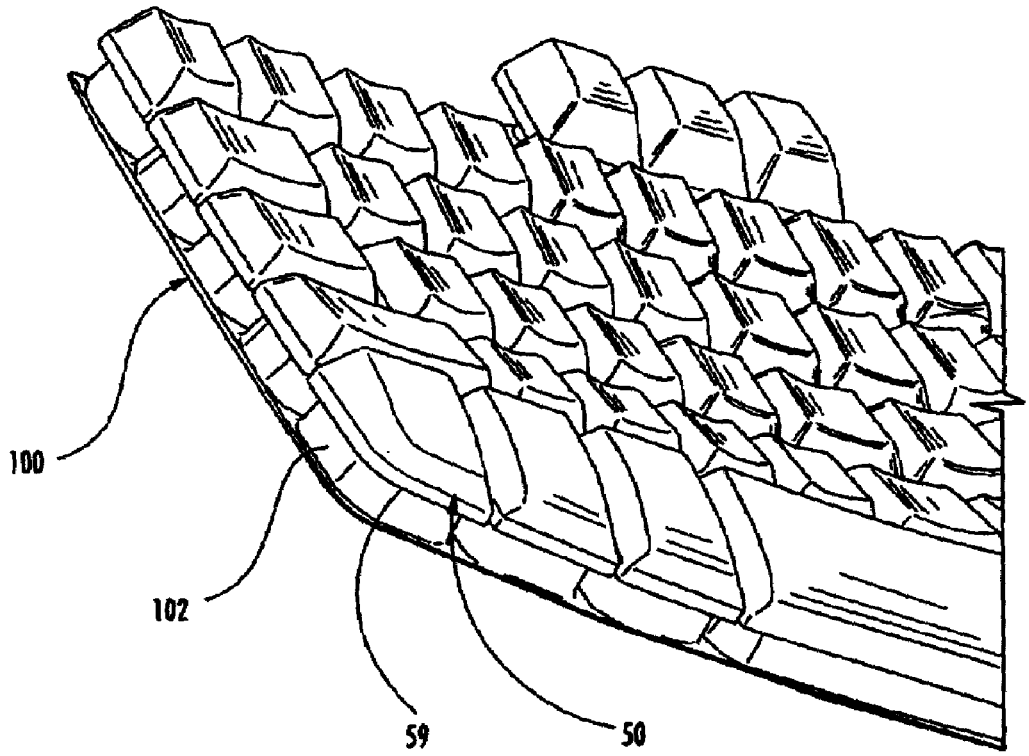
FIG. 21 illustrates alternative elevated view of the embodiment depicted in FIG. 20 in accordance with an aspect of the present invention.

FIGS. 20 and 21 illustrate a plurality of input keys 50 inserted into the barrier layer 100. As depicted, the interface between the support leg 56 and the barrier layer 100 surrounding the key aperture 101 is protected from direct spills. Therefore, as noted above, such a design allows gravity to channels spilt liquid away from the junction 150 and thus tends to make the design more impermeable to liquids. As can be appreciated, however, if the keyboard 10 is to be configured to be rinsed under running water, the junction between the barrier layer 100 and the input key 50 should be substantially impermeable to liquids. To accomplish this, a greater degree of stack-up (e.g. more of an interference fit) between the barrier layer 100 and the input key 50 may be beneficial.

The present invention has been described in terms of preferred and exemplary embodiments thereof. Numerous other embodiments, modifications and variations within the scope and spirit of the appended claims will occur to persons of ordinary skill in the art from a review of this disclosure.

I claim:

1. A computer keyboard comprising:

a housing, the housing including an upper housing portion and a lower housing portion, wherein the upper housing portion includes a key opening and a first sealing surface, and the lower housing portion includes a second sealing surface;

a keyboard circuit supported by the lower housing portion;

a barrier layer sealably mounted between the first sealing surface of the upper housing portion and the second sealing surface of the lower housing portion, the barrier layer including a key aperture; and an input key movably mounted to the lower housing portion, the input key being attached to the barrier layer around the key aperture of barrier layer, the input key including a support leg that is configured to interface with the keyboard circuit, whereby the input key, the barrier layer and the lower housing portion form a substantially liquid impermeable pocket around the keyboard circuit.

2. The keyboard of claim 1, wherein the key aperture is a first key aperture and the input key is a first input key, wherein the barrier layer includes a second key aperture and the keyboard further comprises a second input key movably mounted to the lower housing portion, the second input key being attached to the barrier layer around the second key aperture.

3. The keyboard of claim 1, wherein the barrier layer includes an upwardly extending projection having a top surface and a barrier wall, wherein the key aperture is located on the top surface.

4. The keyboard of claim 1, wherein the barrier layer comprises silicone and the key aperture is smaller than a perimeter of the input key at a junction between the input key and the barrier layer, whereby the barrier layer has an interference fit with the input key.

5. The keyboard of claim 1, wherein the upper housing portion includes a drain hole located above the first sealing surface, the drain hole configured to enable a user to remove a liquid from the barrier layer.

6. The keyboard of claim 1, wherein the keyboard includes at least one fastener, the at least one fastener attaching the lower housing portion to the upper housing portion, the at least one fastener located outside a perimeter seal formed by the first sealing surface, the barrier layer and the second sealing surface.

7. The keyboard of claim 1, wherein displacement of the input key in a downward direction by a user causes the barrier layer to deflect.

8. A keyboard comprising:

a housing including an upper housing portion and a lower housing portion, wherein the upper housing portion includes a first sealing surface and a key opening, the first sealing surface forming a first perimeter around the key opening and wherein the lower housing portion includes a second sealing surface;

a keyboard circuit contained within the housing;

a plurality of key wells supported by the lower housing portion;

a plurality of input keys, the plurality of input keys supported by the plurality of key wells, each of the plurality of keys having a support leg configured to interface with the keyboard circuit; and a barrier layer having a plurality of key apertures, each key aperture receiving a respective support leg therethrough, the barrier layer fitted to the plurality of support legs and positioned between the first sealing surface and the second sealing surface.

9. The keyboard of claim 8, wherein the first sealing surface is on a first sealing rib and the second sealing surface is on a second sealing rib, wherein the first and second sealing ribs are configured to mate when the upper housing portion is fastened to the lower housing portion.

10. The keyboard of claim 9, wherein the upper housing portion includes a first outer rib and the lower housing portion includes a second outer rib, wherein the first and second outer ribs form an outer perimeter and the first perimeter is inside the outer perimeter.

11. The keyboard of claim 10, wherein the barrier layer includes a plurality of upwardly extending projections having a plurality of top surfaces, wherein the plurality of key apertures are provided on the plurality of top surfaces of the plurality of upwardly extending projections.

12. The keyboard of claim 8, wherein the barrier layer comprises molded silicone.

13. The keyboard of claim 8, wherein the dimensions of the plurality of key apertures are smaller than the dimensions of the plurality of support legs so as to provide an interference fit between the barrier layer and the plurality of support legs.

14. A keyboard for use in providing user input, the keyboard comprising:

a housing including an upper housing portion and a lower housing portion, wherein the upper housing portion includes a key opening surrounded by a first sealing surface and further including a first outer edge and wherein the lower housing portion includes a second sealing surface for mating with the first sealing surface and further includes a second outer edge;

a keyboard circuit supported by the lower housing portion;

an input key movably mounted to the lower housing portion, the input key including a support leg, the support leg configured to interface with the keyboard circuit; and a barrier layer positioned between the first and second sealing surfaces, the barrier layer attached to the support leg of the input key.

15. The keyboard of claim 14, wherein the first sealing surface is coextensive with the first outer edge.

16. The keyboard of claim 14, wherein at least a portion of the first sealing surface is inside of the first outer edge.

17. The keyboard of claim 14, wherein the keyboard further comprises a panel releaseably mounted to the lower housing portion.

18. The keyboard of claim 14, wherein the barrier layer comprises molded silicone.

19. The keyboard of claim 14, wherein the barrier layer includes an upwardly extending projection having a top surface, the barrier layer further including a key aperture on the top surface, wherein the input key attaches to the barrier layer around the key aperture.

20. The keyboard of claim 19, wherein the input key comprises at least one side wall connecting a key edge and a key top surface, the at least one side wall having an inner surface, wherein the key aperture of the barrier layer is positioned between the key edge and the key top surface inside the inner surface of the at least one side wall.

* * * * *